US006658878B2

(12) United States Patent
Shim et al.

(10) Patent No.: US 6,658,878 B2
(45) Date of Patent: Dec. 9, 2003

(54) MULTI-COMPARTMENT TYPE REFRIGERATOR AND METHOD FOR CONTROLLING THE SAME

(75) Inventors: Yong-Bo Shim, Kwangju (KR); Hee-Soo Lee, Kwangju (KR); Cheol-Hee Kim, Kwangju (KR)

(73) Assignee: Samsung Electronics Co., Ltd., Suwon (KR)

( * ) Notice: Subject to any disclaimer, the term of this patent is extended or adjusted under 35 U.S.C. 154(b) by 175 days.

(21) Appl. No.: 09/933,729

(22) Filed: Aug. 22, 2001

(65) Prior Publication Data

US 2002/0134096 A1 Sep. 26, 2002

(30) Foreign Application Priority Data

Mar. 26, 2001 (KR) ..... 10-2001-15724
May 29, 2001 (KR) ..... 2001-29743

(51) Int. Cl.[7] ..... F25D 11/02; F25D 29/00

(52) U.S. Cl. ..... 62/229; 62/131; 62/161; 62/199

(58) Field of Search ..... 62/229, 228.1, 62/198, 199, 200, 203, 204, 205, 208, 209, 210, 213, 161, 163, 131

(56) References Cited

U.S. PATENT DOCUMENTS 2,791,101 A * 5/1957 Zearfoss, Jr. ..... 62/229 X
4,510,767 A * 4/1985 Komatsu et al. ..... 62/200
5,272,884 A 12/1993 Cur et al. ..... 62/199
5,743,104 A 4/1998 Kim et al. ..... 62/209
5,771,701 A * 6/1998 Suh ..... 62/229 X
5,787,718 A 8/1998 Jeong ..... 62/157
6,138,460 A 10/2000 Lee ..... 62/89
6,497,113 B1 * 12/2002 Yamada et al. ..... 62/199 X

FOREIGN PATENT DOCUMENTS

| | | |
|---|---|---|
| DE | 4122165 | 1/1993 |
| GB | 2 083 928 | 9/1980 |
| JP | 11-304332 | 11/1999 |

* cited by examiner

*Primary Examiner*—Harry B. Tanner
(74) *Attorney, Agent, or Firm*—Robert E. Bushnell, Esq.

(57) ABSTRACT

Disclosed herein is a multi-compartment type refrigerator and method for controlling the same. The refrigerator includes a plurality of storage compartments. A plurality of evaporators are each positioned in each of the storage compartments, respectively. A compressor supplies refrigerant to the evaporators through a branched refrigerant conduit. A plurality of opening/closing valves are each positioned on a refrigerant conduit upstream of each of the evaporators for selectively controlling supply of refrigerant to the evaporators. Reference compartment defining means defines as a reference storage compartment one of the storage compartments that has a relatively great load. Control means controls starting of the compressor depending on a change of a temperature of the reference storage compartment.

10 Claims, 6 Drawing Sheets

MULTI-COMPARTMENT TYPE REFRIGERATOR AND METHOD FOR CONTROLLING THE SAME

CLAIM OF PRIORITY

This application makes reference to, incorporates the same herein, and claims all benefits accruing under 35 U.S.C. §119 from my application entitled MULTI-ROOM REFRIGERATOR AND CONTROL METHOD THEREOF filed with the Korean Industrial Property Office on Mar. 26, 2001 and there duly assigned Serial No. 2001-15724 and my application entitled MULTI-ROOM REFRIGERATOR AND CONTROL METHOD THEREOF filed with the Korean Industrial Property Office on May 29, 2001 and there duly assigned Serial No. 2001-29743.

BACKGROUND OF THE INVENTION

1. Field of the Invention

The present invention relates generally to a multi-compartment type refrigerator and method for controlling the same, and more particularly to a multi-compartment type refrigerator and method for controlling the same, which is capable of appropriately controlling the starting of a compressor, thereby stabilizing the refrigeration cycle of the multi-compartment type refrigerator and saving the required energy of the multi-compartment type refrigerator.

2. Description of the Prior Art

In general, in a multi-compartment type refrigerator, the entire storage compartment is partitioned into a plurality of storage compartments, a plurality of evaporators are each positioned in each of the storage compartments to refrigerate the storage compartment, and a single compressor is connected to the evaporators via a branched refrigerant conduit to supply refrigerant. In particular, the above-described construction can be applied to a specially designed refrigerator in which the refrigerant conduits of evaporators are positioned in the vicinity of the walls of the storage compartments and the storage compartments are refrigerated by the evaporators via the walls of the storage compartments.

In such a multi-compartment type refrigerator, the temperatures of the storage compartments are detected by a plurality of temperature sensors each positioned in each of the storage compartments, temperature information detected in the storage compartments are transmitted to a control unit for controlling the operation of the multi-compartment type refrigerator, and the starting of the compressor is controlled on the basis of the temperature information. Additionally, a plurality of opening/closing valves, which are selectively opened or closed by the control signal of the control unit, are positioned on a refrigerant conduit connected to the evaporators, and control the supply of refrigerant from the compressor to the evaporators.

Accordingly, in the conventional multi-compartment type refrigerator, the rise of the temperature of each of the storage compartments over a preset reference temperature is sensed by the temperature sensor, and the refrigeration of the storage compartment is performed by the control of the control unit in such a way that the refrigerant conduit connected to the corresponding storage compartment is opened by controlling the opening/closing valve and the compressor is started.

However, the conventional multi-compartment type refrigerator is controlled in such a way that the compressor is stopped if all the temperatures of the storage compartments rise over the reference temperature, while the compressor is immediately started when at least one of the temperatures of the storage compartments rises over the reference temperature, so the compressor is frequently started and stopped, thereby causing the instability of the refrigeration cycle and the loss of energy.

SUMMARY OF THE INVENTION

Accordingly, the present invention has been made keeping in mind the above problems occurring in the prior art, and an object of the present invention is to provide a multi-compartment type refrigerator and method for controlling the same, in which the starting of a compressor is controlled on the basis of the temperature of a single storage compartment that has a relatively great refrigeration load, thereby stabilizing the refrigeration cycle of the multi-compartment type refrigerator by preventing the compressor from being frequently started and stopped, and saving required energy by reducing the operation time of the compressor.

In order to accomplish the above object, the present invention provides a multi-compartment type refrigerator, comprising a plurality of storage compartments; a plurality of evaporators each positioned in each of the storage compartments, respectively; a compressor for supplying refrigerant to the evaporators through a branched refrigerant conduit; a plurality of opening/closing valves each positioned on a refrigerant conduit upstream of each of the evaporators for selectively controlling supply of refrigerant to the evaporators; reference compartment defining means for defining as a reference storage compartment one of the storage compartments that has a relatively great load; and control means for controlling starting of the compressor depending on a change of a temperature of the reference storage compartment.

Preferably, the reference compartment defining means is a selection switch that is capable of previously defining one of the storage compartments as the reference storage compartment.

Preferably, the reference compartment defining means compares accumulated opening times of the opening/closing valves with each other and defines one of the storage compartments, which has a relatively great accumulated opening time, as the reference storage compartment, after independently refrigerating the storage compartments for a predetermined time.

Additionally, the present invention provides a method for controlling a multi-compartment type refrigerator, the multi-compartment type refrigerator having a plurality of storage compartments each provided with a temperature sensor for sensing temperatures of the storage compartments, a plurality of evaporators for each refrigerating each of the storage compartments, a compressor for supplying refrigerant to the evaporators via a branched refrigerant conduit, and a plurality of opening/closing valves positioned on a refrigerant conduit upstream of the evaporators for controlling supply of refrigerant to the evaporators, comprising the steps of defining as a reference storage compartment one of the storage compartments that has a relatively great refrigeration load (a reference compartment defining step); and controlling starting of the compressor on a temperature of the reference storage compartment selected in the reference compartment defining step (a reference compartment control step).

Preferably, the reference compartment defining step is defining the reference storage compartment by a user's selection through manipulation of a selection switch.

Preferably, the reference compartment defining step comprises the steps of controlling an opening/closing valve, concerning a storage compartment desired to be refrigerated, to be opened and the compressor to be started, when one of the storage compartments is desired to be refrigerated (an independent control step); accumulating opening times of the opening/closing valves for a predetermined time for which the independent control step is performed; and defining as the reference storage compartment a single storage compartment concerning an opening/closing valve that has a longest accumulated opening time, by comparing accumulated opening times of the opening/closing valves with one another.

The reference compartment defining step comprises the steps of controlling an opening/closing valve, concerning a storage compartment desired to be refrigerated, to be opened and the compressor to be started, when one of the storage compartments is desired to be refrigerated (an independent control step); accumulating times, for which temperatures of the storage compartments are kept over the reference temperature, for a predetermined time for which the independent control step is performed; and defining as the reference storage compartment a single storage compartment that is kept over the reference temperature for a relatively long time, by comparing accumulated times for which temperatures of the storage compartments are kept over the reference temperature.

Preferably, the method of the present invention further comprises the step of restarting from the reference compartment defining step when each of the doors is opened while the reference defining step or the reference compartment control step is performed.

Preferably, the reference compartment control step comprises the steps of controlling an opening/closing valve concerning the reference storage compartment to be opened and the compressor to be started, only when a temperature of the reference storage compartment is over the reference temperature; detecting temperatures of storage compartments other than the reference storage compartment when the compressor is started; and controlling an opening/closing valve concerning a corresponding storage compartment to be opened when a temperature of at least one of storage compartments other than the reference storage compartment is over the reference temperature, and controlling an opening/closing valve concerning a corresponding storage compartment to be kept closed when a temperature of at least one of storage compartments other than the reference storage compartment is equal to or below the reference temperature.

Preferably, the reference compartment control step further comprises the step of stopping the compressor if all temperatures of storage compartments other than the reference storage compartment are equal to or below the reference temperature.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DESCRIPTION OF THE PREFERRED EMBODIMENTS

Figure 1:
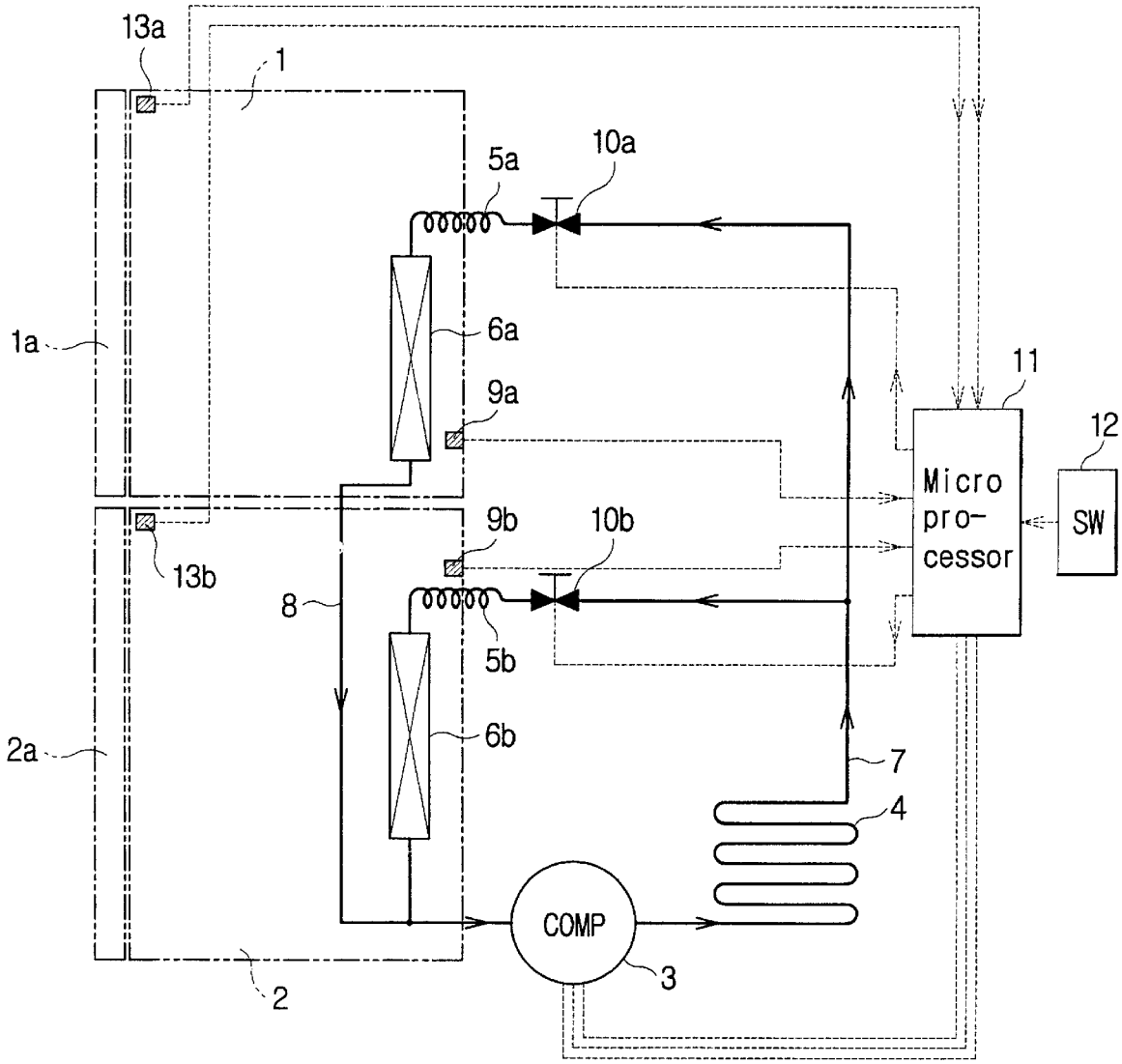
FIG. 1 is a diagram showing the refrigeration cycle of a multi-compartment type refrigerator in accordance with the present invention.
Figure 2:
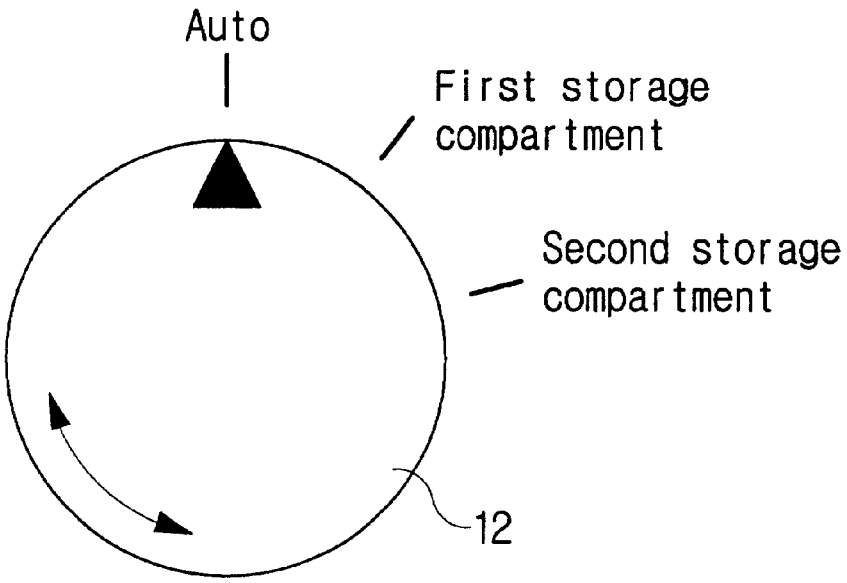
FIG. 2 is a plan view showing a selection switch applied to the multi-compartment type refrigerator of the present invention.

As illustrated in FIG. 1, a multi-compartment type refrigerator in accordance with the present invention includes first and second storage compartments 1 and 2 that are separated from each other. The first and second storage compartments 1 and 2 are each provided with an openable door 1*a* or 2*a* to allow food to be stored in one of the compartments 1 and 2. A refrigeration apparatus is embodied in the multi-compartment type refrigerator of the present invention, and includes a compressor 3, a condenser 4, two refrigerant expanding devices 5*a* and 5*b* and two evaporators 6*a* and 6*b*.

The evaporators is comprised of first and second evaporators 6*a* and 6*b* that refrigerate the first and second storage compartments 1 and 2, respectively. The compressor 3, the condenser 4, the refrigerant expanding devices 5*a* and 5*b* and the evaporators 6*a* and 6*b* are connected to each other by refrigerant conduits 7 and 8 so as to circulate refrigerant.

In this case, for the refrigerant conduit 7 connecting the outlet of the condenser 4 to the inlets of the evaporators 6*a* and 6*b*, one line branches into two lines; for the refrigerant conduit 8 connecting the outlets of the evaporators 6*a* and 6*b* to the inlet of the compressor 3, two lines merges into one line. Each of the first and second evaporators 6*a* and 6*b* is a direct refrigeration type evaporator in which its refrigerant conduit is interiorly situated to be in contact with the wall of each storage compartment 1 or 2 so as to keep ripen food such as Kimchi in refrigeration, so the evaporator 6*a* or 6*b* cools the interior of the storage compartment 1 or 2 through the wall of the storage compartment 1 or 2. Each of the coolant expanding devices 5*a* and 5*b* consists of a conventional capillary tube, and is positioned on each line of the refrigerant tube 7.

The present invention is directed to both adjustment of the temperatures of the storage compartments 1 and 2 and control of the operation of the compressor 3. The multi-compartment refrigerator of the present invention includes first and second temperature sensors 9*a* and 9*b* for respectively sensing the temperatures of the first and second storage compartments 1 and 2, first and second door sensors 13*a* and 13*b* for respectively sensing the opening of the doors 1*a* and 2*a* of the storage compartments 1 and 2, first and second opening/closing valves 10*a* and 10*b* for respectively controlling refrigerant supply to the evaporators 6*a* and 6*b*, and a micro processor 11 for controlling the operation of the above-described components.

The first and second temperature sensors 9*a* and 9*b* are positioned in the first and second storage compartments 1 and 2, respectively. The door sensors 13*a* and 13*b* are positioned in the vicinity of the doors 1*a* and 2*a*. The first and second opening/closing valves 10*a* and 10*b* are positioned on the two lines of the refrigerant conduit 7 connected to the inlets of the evaporators 6*a* and 6*b*. Since a compressor operating unit (that operates the compressor 3 in response to a control signal of the micro processor 11) and valve operating units (that operate the opening/closing valves 10*a* and 10*b*) are conventionally employed in the construction of a control circuit, the description of them is omitted here. Although in this embodiment the multi-compartment type refrigerator, in which its entire storage compartment is partitioned into two storage compartments, is only taken as an example, the present invention can be applied to a multi-compartment type refrigerator in which its entire storage compartment is partitioned into three or more storage compartments. In this case, the basic construction of the multi-compartment type refrigerator of this case is similar to the construction of the multi-compartment type refrigerator of this embodiment except that a difference lies in the number of evaporators, temperature sensors, door sensors and opening/closing valves.

Dotted lines shown in FIG. 1 indicate wiring for transmitting signals between each of the temperature sensors 9*a* and 9*b* and the micro processor 11, between each of the door sensors 13*a* and 13*b* and the micro processor 11, between each of the opening/closing valves 10*a* and 10*b* and the micro processor 11, and between the compressor 3 and the micro processor 11, respectively. This construction serves to transmit the temperature information of the storage compartments 1 and 2 obtained by the temperature sensors 9*a* and 9*b* and the door opening information of the doors 1*a* and 2*a* obtained by the door sensors 13*a* and 13*b* to the microprocessor 11. Additionally, this construction serves to allow the microprocessor 11 to determine the conditions of the storage compartments 1 and 2 on the basis of the information and control the operation of the compressor 3 and the opening/closing of the opening/closing valves 10*a* and 10*b*.

The present invention is characterized in that a storage compartment, which has a relatively great refrigeration load because the amount of stored items is relatively large or its reference temperature is relatively high, is defined as a reference storage compartment and the operation of the compressor 3 is controlled depending on the condition of the reference storage compartment, thereby stabilizing the refrigeration cycle of the multi-compartment refrigerator and saving energy by reducing the operation time of the compressor 3.

To this end, in the multi-compartment type refrigerator of the present invention, the reference storage compartment is manually defined by a user or automatically defined by the defining of the microprocessor 11. For the definition, a selection switch 12 is provided. The selection switch 12 is constructed to be capable of selecting one of the first and second storage compartments 1 and 2 as the reference storage compartment or selecting an automatic mode by the manipulation of the selection switch 12. Additionally, the selection switch 12, as shown in FIG. 1, is connected to the microprocessor 11 to allow selection information to be transmitted to the microprocessor 11. Although not shown in the drawing, the selection switch 12 may consist of a plurality of conventional switch buttons.

Hereinafter, a method for controlling the multi-compartment refrigerator in accordance with the present invention is described.

Figure 3:
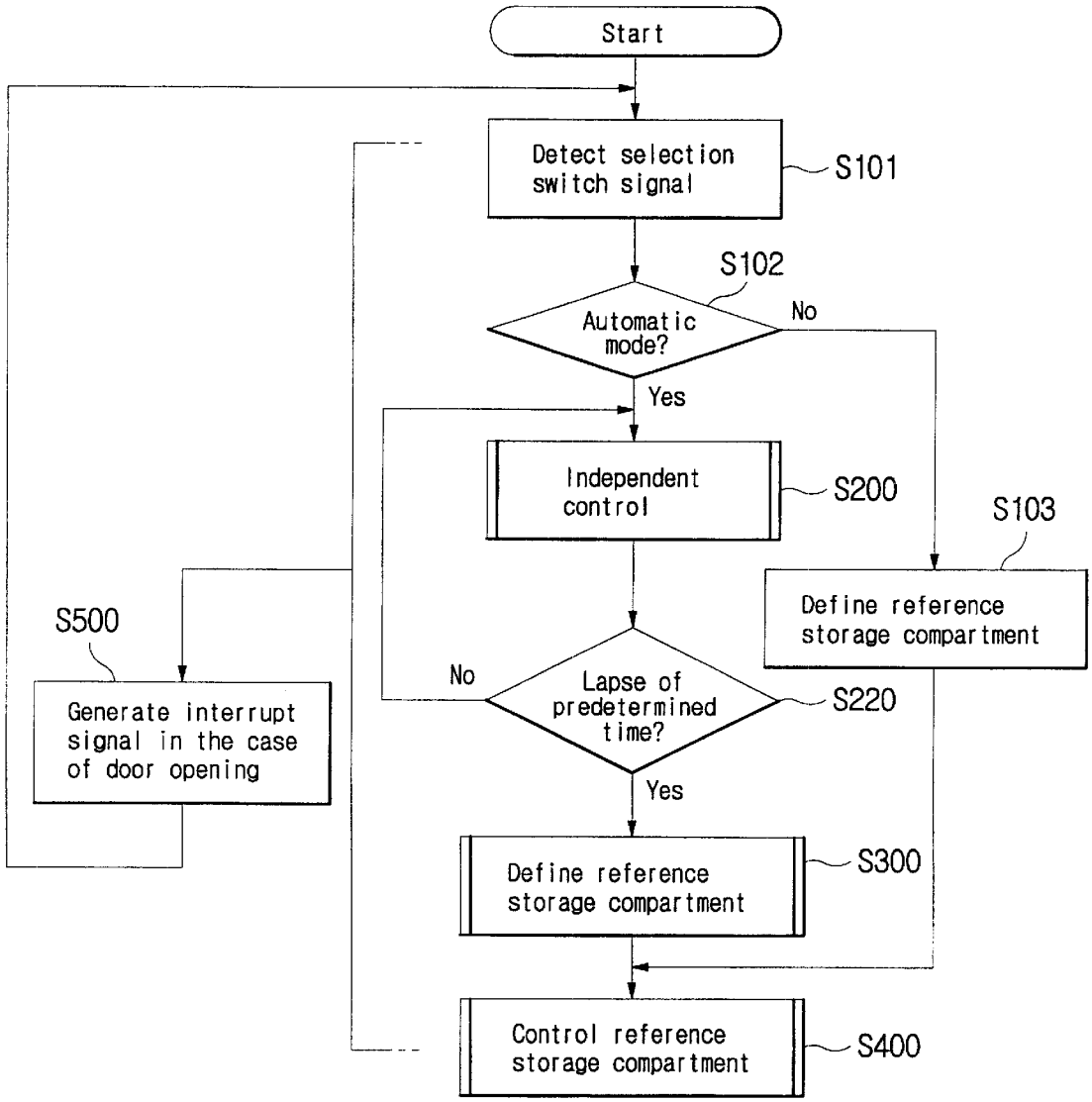
FIG. 3 is a flowchart showing a method for controlling the multi-compartment type refrigerator in accordance with the present invention.

As depicted in FIG. 3, when the refrigerator is started, the microprocessor 11 detects the signal of the selection switch 12 to recognize reference compartment selection information from the selection switch 12 (S101). The microprocessor 11 determines if an automatic mode or manual mode has been selected by the selection switch 12 (S102). If the automatic mode has not been selected (that is, the manual mode has been selected), the microprocessor 11 determines if the selected reference storage compartment is the first or second compartment 1 or 2 (S103) and a reference compartment control step (S400) is immediately performed on the basis of the selection information. Meanwhile, if the automatic mode has been selected, an independent control step (S200) in which the microprocessor 11 defines a reference storage compartment by itself is performed for a predetermined time.

Figure 4:
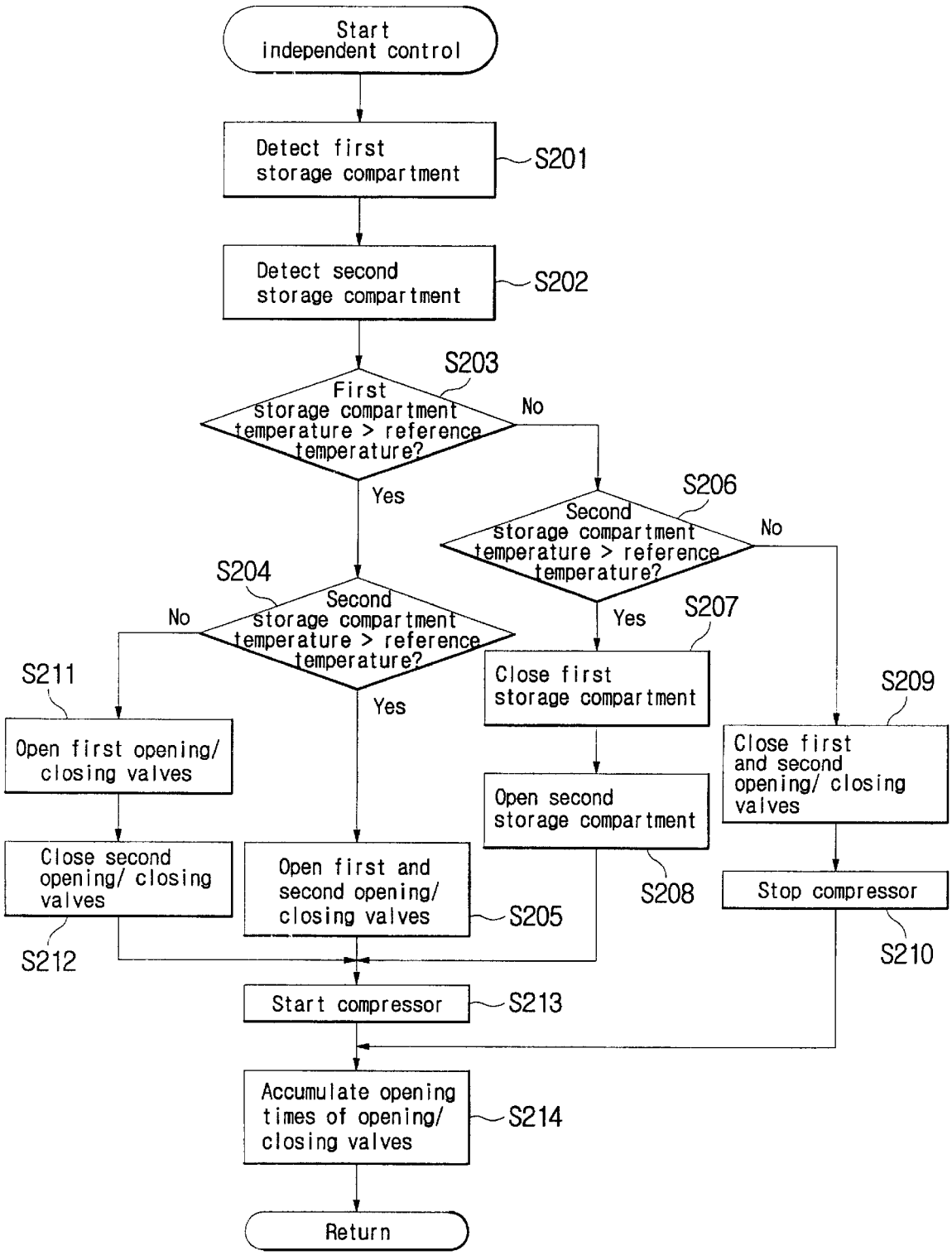
FIG. 4 is a flowchart showing the independent control step of the multi-compartment type refrigerator controlling method.

As indicated in FIG. 4, at the independent control step (S200), the temperatures of the first and second storage compartments 1 and 2 are measured by the first and second temperature sensors 9*a* and 9*b*, and it is determined if the temperature of the first storage compartment 1 rises over a reference temperature (S203). After STEP S203, it is determined if the temperature of the second storage compartment 2 rises over the reference temperature (S204 and S206). If all the temperatures of the first and second storage compartments 1 and 2 rise over the reference temperature, the first and second opening/closing valves 10*a* and 10*b* are opened (S205) and, thereafter, the compressor 3 is started (S213). If the temperature of the first storage compartment 1 is equal to or below the reference temperature and the temperature of the second storage compartment 2 rises over the reference temperature, the first opening/closing valve 10*a* is closed (S207) and the second opening/closing valve 10*b* is opened (S208), and, thereafter, the compressor 3 is started (S213). If all the temperatures of the first and second storage compartments 1 and 2 are equal to or over the reference temperature, all the first and second opening/closing valves 10*a* and 10*b* are closed (S209) and, thereafter, the compressor 3 is kept stopped (S210). If the temperature of the first storage compartment 1 rises over the reference temperature and the temperature of the second storage compartment 2 is equal to or below the reference temperature, the first opening/closing valve 10*a* is opened (S211) and the second opening/closing valve 10*b* is closed (S212), and, thereafter, the compressor 3 is started (S213). If the compressor 3 is started, the opening times of the first and second opening/closing valves 10*a* and 10*b* are accumulated so as to define one of the first and second storage compartments 1 and 2 as the reference storage compartment (S214). At these control steps, the corresponding storage compartment 1 or 2 can be refrigerated by the starting of the compressor 2 when any one of the storage compartments 1 and 2 is required to be refrigerated, and the refrigeration loads of the storage compartments 1 and 2 are determined by the accumulation of the opening times (refer to STEP S214).

The independent control step (S200), as shown in FIG. 3, is continued for a predetermined time (S220). The predetermined time for which the independent control step (S220) is performed may be defined as the time for which the refrigeration cycle of the multi-compartment type refrigerator is stabilized. After the independent control step (S200) is finished by the lapse of the predetermined time, a reference compartment defining step (S300) is performed by determining which of the storage compartments 1 and 2 has a relatively great refrigeration load and defining as the reference storage compartment one of the storage compartments 1 or 2 that has a relatively great refrigeration load.

Figure 5:
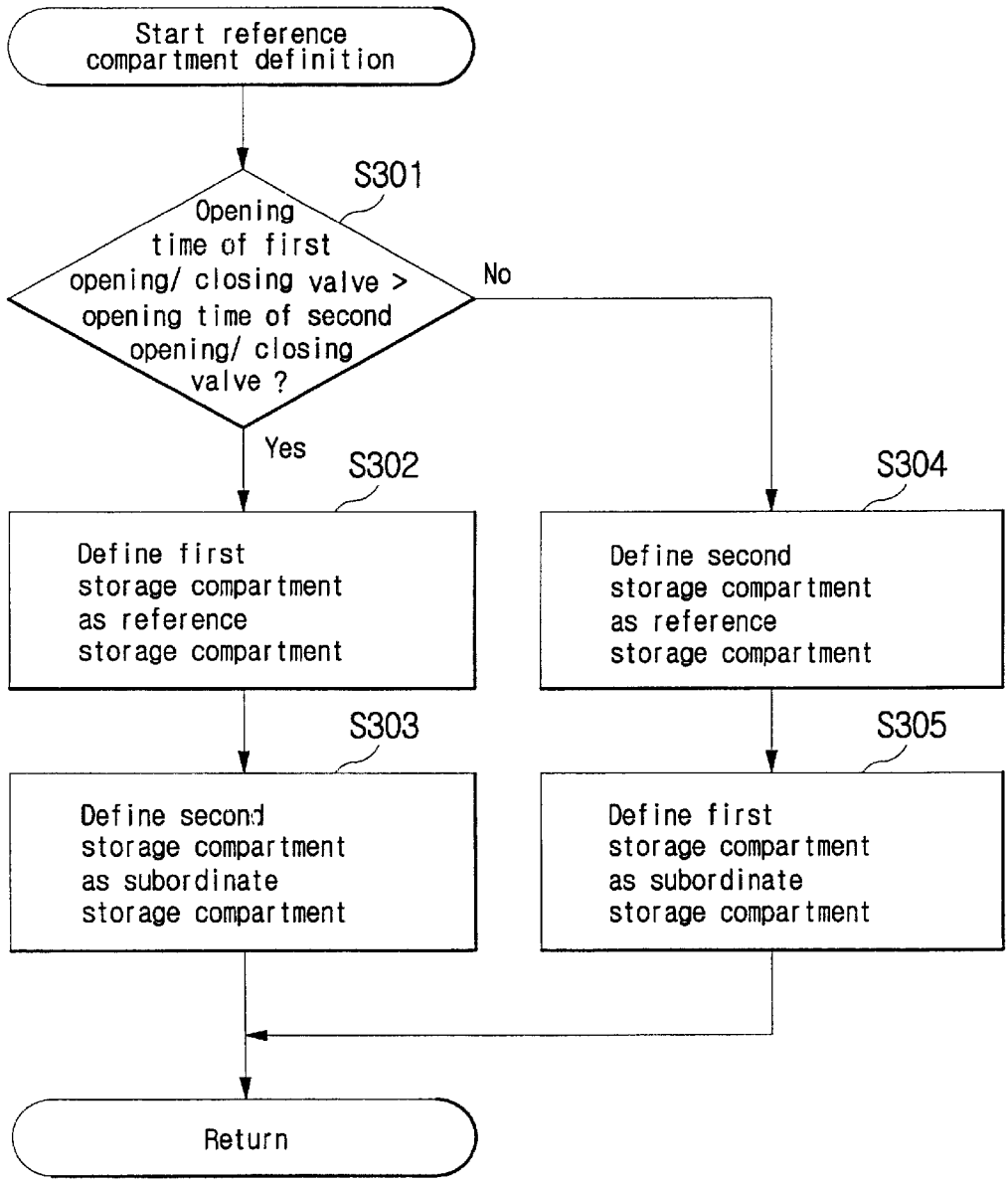
FIG. 5 is a flowchart showing the reference compartment defining step of the multi-compartment type refrigerator controlling method.

Referring to FIG. 5, at the reference compartment defining step (S300), it is determined if the accumulated opening times of the first opening/closing valve 10*a* is longer than the accumulated opening times of the second opening/closing valve 10*b* so as to determine which of the storage compartments 1 and 2 has a relatively great refrigeration load during the independent control step (S301). If the accumulated opening time of the first opening/closing valve 10*a* is longer than the accumulated opening time of the second opening/closing valve 10*b*, the first storage compartment 1 is selected as the reference storage compartment for the starting of the compressor 3 (S302) and the second storage compartment 2 is selected as a subordinate storage compartment (S303). In the contrary case, the second storage compartment 2 is selected as the reference storage compartment for the starting of the compressor 3 (S304) and the first storage compartment 1 is selected as a subordinate storage compartment (S305). After the reference storage compartment is selected at the reference compartment defining step (S300), a reference storage compartment control step (S400) is performed (refer to FIG. 3).

In the meantime, although not shown in accompanying drawings, there can be employed as the reference compartment defining method another method in which the times for which the storage compartments 1 and 2 have been kept over the reference temperature are measured and the storage compartment 1 or 2 that has been kept over the reference temperature for a relatively long time is defined as the reference storage compartment by the comparison of the times. For this method, at the independent control step (S300), the microprocessor 11 measures and accumulates the times for which the storage compartments 1 and 2 have been kept over the reference temperature instead of accumulating the opening times of the opening/closing valves 10*a* and 10*b* (refer to STEP S214). At the reference compartment defining step (S300), the accumulated times for which the storage compartments 1 and 2 have been kept over the reference temperature are compared with each other and the storage compartment 1 or 2 that has been kept over the reference temperature for a relatively long, accumulated time, instead of comparing the accumulated opening times of the opening/closing valves 10*a* and 10*b* with each other (refer to STEP S301).

Figure 6:
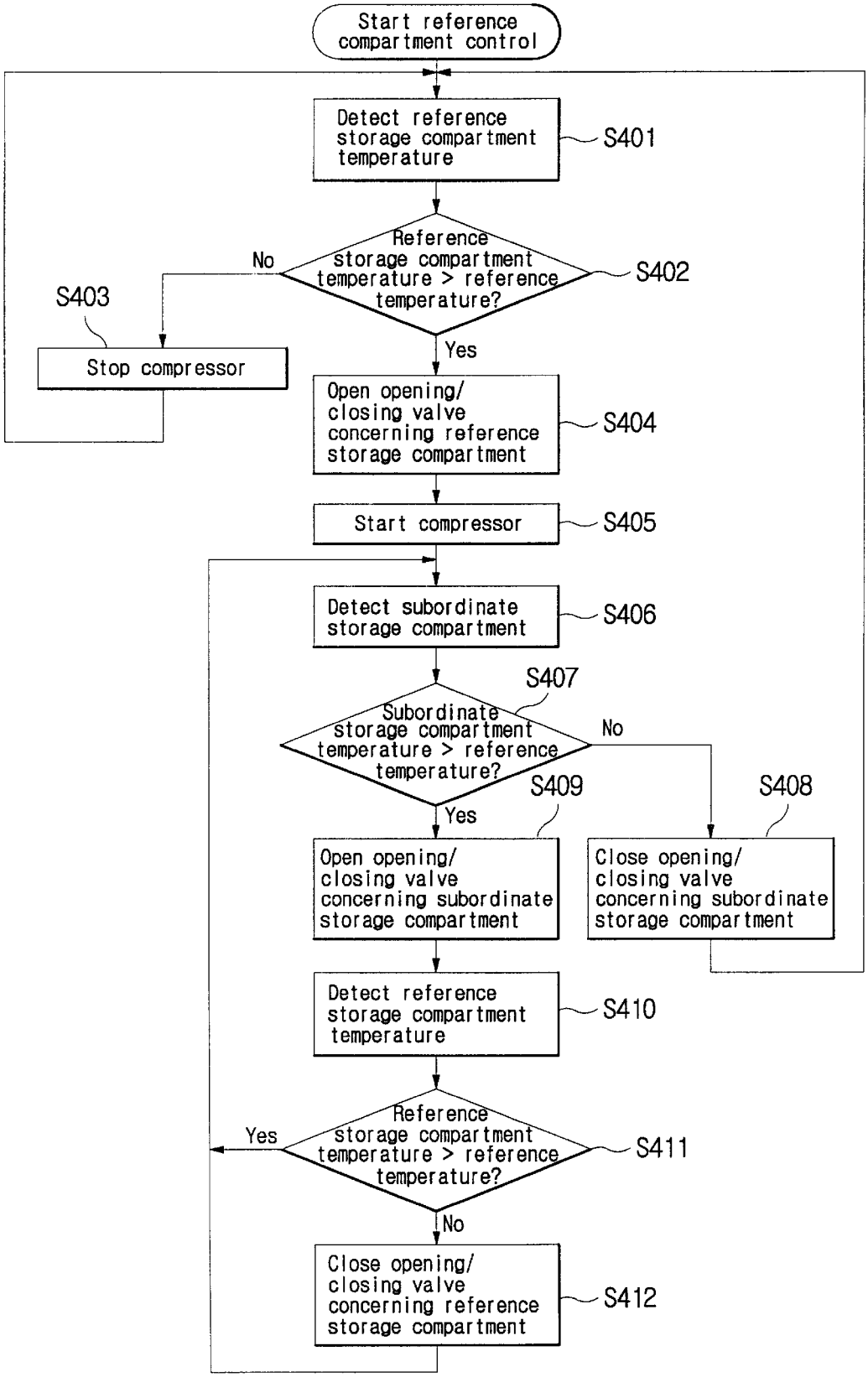
FIG. 6 is a flowchart showing the reference compartment control step of the multi-compartment type refrigerator controlling method.

As shown in FIG. 6, at the reference compartment control step (S400), the temperature of the reference storage compartment defined at the reference compartment defining step (S300) is detected (S401) and it is determined if the temperature of the reference storage compartment is over the reference temperature (S402). For example, if at the reference compartment defining step (S300) the first storage compartment 1 is defined as the reference storage compartment and the second storage compartment 2 is defined as the subordinate storage compartment, the temperature of the first storage compartment 1 is detected by the first temperature sensor 9*a* positioned in the first storage compartment 1 and it is determined if the temperature of the first storage compartment 1 is over the reference temperature.

In this case, if the temperature of the reference storage compartment is over the reference temperature, the opening/closing valve concerning the reference storage compartment is opened (S404) and the compressor 3 is started (S405). In the contrary case, the compressor 3 is kept stopped (S403). These steps allow the starting of the compressor 3 to be performed depending on the condition of the reference storage compartment. That is, if the first storage compartment is defined as the reference storage compartment, the starting of the compressor 3 is performed only when the temperature of the first storage compartment 1 rises over the reference temperature.

After the compressor 3 is started, the temperature of the reference storage compartment 1 is detected (S406) and it is determined if the temperature of the subordinate storage compartment is over the reference temperature (S407). In this case, if the temperature of the subordinate storage compartment is over the reference temperature, the opening/closing valve concerning the subordinate storage compartment is opened to supply refrigerant to the evaporator positioned in the subordinate storage compartment and refrigerate the subordinate storage compartment (S409). On the contrary, if the temperature of the subordinate storage compartment is equal to or below the reference temperature, the opening/closing valve concerning the subordinate storage compartment is kept closed and the multi-compartment type refrigerator of the present invention is returned to STEP S401 (S408). That is, in this case, only the reference storage compartment is refrigerated. At these control steps, the condition of the subordinate storage compartment is determined after the starting of the compressor 3, and the reference storage compartment is refrigerated only when the refrigeration of the subordinate storage compartment is required.

After the refrigeration of the subordinate storage compartment is started (S409) by the opening of the opening/closing valve concerning the subordinate storage compartment, the temperature of the subordinate storage compartment is detected (S410) and it is determined if the temperature of the reference storage compartment is over the reference temperature (S411). In this case, if the temperature of the reference storage compartment is over the reference temperature, the multi-compartment type refrigerator of the present invention is returned to STEP S406 to continue the refrigeration of the reference storage compartment. If the temperature of the reference storage compartment is equal to or below the reference temperature, the opening/closing valve concerning the reference storage compartment is closed to stop the refrigeration of the reference storage compartment and the multi-compartment type refrigerator of the present invention is returned to STEP S406 to continue the refrigeration of the subordinate storage compartment (S412).

At these control steps, after the compressor 3 is started, the compressor 3 can be stopped after the temperatures of the reference and subordinate storage compartments are equal to or below the reference temperature. That is, the starting of the compressor 3 is performed depending on the temperature of the reference storage compartment and the stopping of the compressor 3 is performed when the temperatures of all the reference and subordinate storage compartments are equal to or below the reference temperature. These steps serve to stabilize the refrigeration cycle of the multi-compartment type refrigerator of the present invention by continuously operating the compressor 3 after the starting of the compressor 3, and to save energy by preventing the compressor 3 from being frequently started and stopped and, accordingly, reducing the operation time of the compressor 3.

In addition, as shown in FIG. 3, if the opening of one of the doors 1*a* and 2*a* of the storage compartments 1 and 2 is detected by the door sensors 13*a* and 13*b* at the independent control step (S200), the reference compartment defining step (S300) or the reference compartment control step (S400), a door interrupt signal is generated to allow the above-described control procedure to be performed from the initial step (S500). On the other hand, if the doors 1*a* and 1*b* are not opened, the reference compartment control step (S400) is continuously performed.

These steps serve to provide for a case where the storage condition of each storage compartment 1 or 2 is changed by the additional storing of food in the storage compartment 1 or 2 or the taking food out of the storage compartment 1 or 2. If the refrigeration condition of the storage compartment 1 or 2 is changed by the change of the amount of stored food in the storage compartment 1 or 2, the independent control step for defining the reference storage compartment is restarted and the reference compartment control step is reperformed on the basis of newly defined reference storage compartment. Meanwhile, if a user selects the storage compartment 1 or 2 where a relatively large amount of food is stored as the reference storage compartment by the manipulation of the selection switch 12, the reference compartment control step (S400) is directly performed without the performance of the independent control step (S200) and the reference compartment defining step (S300).

As described above, the present invention provides a multi-compartment type refrigerator and method for controlling the same, in which a single storage compartment having a relatively great refrigeration load is defined as a reference storage compartment and the starting of a compressor is controlled depending on the condition of the storage compartment defined as the reference storage compartment, thereby stabilizing the refrigeration cycle of the multi-compartment type refrigerator by preventing the compressor from being frequently started and stopped, and saving energy by reducing the operation time of the compressor.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A multi-compartment type refrigerator, comprising:

a plurality of storage compartments;

a plurality of evaporators each positioned in each of said storage compartments, respectively;

a compressor for supplying refrigerant to said evaporators through a branched refrigerant conduit;

a plurality of opening/closing valves each positioned on a refrigerant conduit upstream of each of said evaporators for controlling supply of refrigerant to said evaporators;

reference compartment defining means for defining as a reference storage compartment one of said storage compartments that has a relatively great load; and control means for controlling starting of said compressor depending on a change of a temperature of said reference storage compartment.

2. The multi-compartment type refrigerator according to claim 1, wherein said reference compartment defining means is a selection switch that is capable of previously defining one of said storage compartments as the reference storage compartment.

3. The multi-compartment type refrigerator according to claim 1, wherein said reference compartment defining means compares accumulated opening times of said opening/closing valves with each other and defines one of said storage compartments, which has a relatively great accumulated opening time, as said reference storage compartment, after independently refrigerating said storage compartments for a predetermined time.

4. A method for controlling a multi-compartment type refrigerator, said multi-compartment type refrigerator having a plurality of storage compartments each provided with a temperature sensor for sensing temperatures of said storage compartments, a plurality of evaporators for each refrigerating each of said storage compartments, a compressor for supplying refrigerant to said evaporators via a branched refrigerant conduit, and a plurality of opening/closing valves positioned on a refrigerant conduit upstream of said evaporators for controlling supply of refrigerant to said evaporators, comprising the steps of:

defining as a reference storage compartment one of said storage compartments that has a relatively great refrigeration load (a reference compartment defining step); and controlling starting of said compressor on a temperature of said reference storage compartment selected in said reference compartment defining step (a reference compartment control step).

5. The method according to claim 4, wherein said reference compartment defining step is defining said reference storage compartment by a user's selection through manipulation of a selection switch.

6. The method according to claim 4, wherein said reference compartment defining step comprises the steps of:

controlling an opening/closing valve, concerning a storage compartment desired to be refrigerated, to be opened and said compressor to be started, when one of said storage compartments is desired to be refrigerated (an independent control step);

accumulating opening times of said opening/closing valves for a predetermined time for which said independent control step is performed; and defining as said reference storage compartment a single storage compartment concerning an opening/closing valve that has a longest accumulated opening time, by comparing accumulated opening times of said opening/closing valves with one another.

7. The method according to claim 4, wherein said reference compartment defining step comprises the steps of:

controlling an opening/closing valve, concerning a storage compartment desired to be refrigerated, to be opened and said compressor to be started, when one of said storage compartments is desired to be refrigerated (an independent control step);

accumulating times, for which temperatures of said storage compartments are kept over said reference temperature, for a predetermined time for which said independent control step is performed; and defining as said reference storage compartment a single storage compartment that is kept over said reference temperature for a relatively long time, by comparing accumulated times for which temperatures of said storage compartments are kept over said reference temperature.

8. The method according to claim 4, further comprising the step of restarting from said reference compartment defining step when each of said doors is opened while said reference defining step or said reference compartment control step is performed.

9. The method according to claim 4, wherein said reference compartment control step comprises the steps of:

controlling an opening/closing valve concerning said reference storage compartment to be opened and said compressor to be started, only when a temperature of said reference storage compartment is over said reference temperature;

detecting temperatures of storage compartments other than said reference storage compartment when said compressor is started; and controlling an opening/closing valve concerning a corresponding storage compartment to be opened when a temperature of at least one of storage compartments other than said reference storage compartment is over said reference temperature, and controlling an opening/closing valve concerning a corresponding storage compartment to be kept closed when a temperature of at least one of storage compartments other than said reference storage compartment is equal to or below said reference temperature.

10. The method according to claim 9, wherein said reference compartment control step further comprises the step of stopping said compressor if all temperatures of storage compartments other than said reference storage compartment are equal to or below said reference temperature.

* * * * *